United States Patent [19]

Loeb et al.

[11] 4,045,830

[45] Sept. 6, 1977

[54] SYSTEM OF PROTECTION BY MODELING

[75] Inventors: Jean Loeb, Strasbourg; Bernard E. Plantif, Saint Medard Enjalles, both of France

[73] Assignee: Societe Nationale des Poudres et Explosifs, France

[21] Appl. No.: 561,029

[22] Filed: Mar. 24, 1975

[30] Foreign Application Priority Data

Mar. 27, 1974 France ..... 74.10536

[51] Int. Cl.[2] ..... A47C 4/54; A61G 7/08; A47C 7/14

[52] U.S. Cl. ..... 5/81 R; 5/367; 297/455; 297/284; 264/89; 264/90; 264/96; 5/361 R; 5/361 B

[58] Field of Search ..... 5/348 R, 355, 347, 82, 5/91, 81 R; 141/65, 76; 181/36 E, 33 R; 417/73, 74, 75, 76, 375; 55/276

[56] References Cited

U.S. PATENT DOCUMENTS

| | | | |
|---|---|---|---|
| 1,237,688 | 8/1917 | Ostenberg | 417/73 |
| 2,150,287 | 3/1939 | Minor | 5/DIG. 2 |
| 2,779,034 | 1/1957 | Arpin | 5/DIG. 2 |
| 2,901,182 | 8/1959 | Cragg et al. | 181/36 E |
| 3,008,214 | 11/1961 | Foster et al. | 5/348 R |
| 3,009,828 | 11/1961 | Rogers | 417/73 X |
| 3,608,961 | 9/1971 | Von Heck | 5/348 R |
| 3,616,471 | 11/1971 | Braun | 5/348 R |
| 3,786,130 | 1/1974 | Baker | 141/65 X |

FOREIGN PATENT DOCUMENTS

| | | | |
|---|---|---|---|
| 324,869 | 6/1970 | Sweden | 5/DIG. 2 |

*Primary Examiner*—James T. McCall
*Attorney, Agent, or Firm*—Bucknam and Archer

[57] ABSTRACT

A system of protection by modeling and/or immobilization comprises at least one flexible and leakproof envelope, a plurality of resilient and deformable balls therein, and means for establishing a vacuum inside the envelope. Two elastic skins joined in leak-proof fashion by their peripheries constitute the envelope, inside which vacuum is created by a vacuum-generating unit including a gas generator. This system can be used in particular for transporting the wounded, or as a seat, the latter being constituted by one or more envelopes.

13 Claims, 18 Drawing Figures

SYSTEM OF PROTECTION BY MODELING

The present invention relates to systems of protection of the type comprising at least one flexible and leakproof envelope, a plurality of resilient bodies in the interior of the envelope, which optionally may be deformable, and means for creating and maintaining a vacuum in the interior of the envelope.

The system of protection is therefore composed of two-parts: a modeling structure constituted by a flexible and leakproof containing the resilient elements in the form of grains or balls, combined with a vacuum-generating unit.

In the absence of a vacuum, the envelope and the mass of grains contained therein is highly malleable, permitting modeling in the same manner as the water beds used in medical applications. The purpose of the vacuum is to transform this malleability into a compact block. This compactness is obtained by imbrication of the balls due to the fact that the internal vacuum creates a pressure difference on both sides of the walls of the flexible envelope with the outer pressure necessarily being higher so that the balls are compressed.

The principle of protection insured by such systems is the distribution of the weight of an element on an area developed to the maximum by the modeling. The stress due to shock or any disturbance, such as for example, vibrations to which a point on the element would be subjected in the absence of the system of protection, is in fact distributed over the entire surface of contact. On the other hand, the immobilization may by itself protect, in the case of a wounded person, against the injuries which might be caused by the relative movement of the different parts of the body with respect to one another.

Many systems of this type have already been used, in particular for the transfer of wounded people; however, the use of these devices is limited because of various drawbacks connected on the one hand with the modeling structure and, on the other hand, with the vacuum-generating unit.

With respect to the modeling structure, the principal drawbacks are the following:

1. Wrinkling on the surface of the envelope in contact with the element to be protected. While the resulting discomfort can be tolerated in the case of an unconscious, wounded person, or a short transit, it becomes prohibitive when the system is to be used as a seat for the protection of any person seated for a substantial period of time.

2. Persistence of the molding, that is to say the imprint left by the object on the envelope after reestablishment of the pressure in the interior of the envelope. This persistence is due to the fact that the imbrication of the balls in the interior of the body of the envelope does not end spontaneously and it is therefore necessary, before using the system again, to impart to the unloaded envelope, a series of more or less severe blows, to restore the original state.

As to the vacuum-generating unit, the principal drawbacks are the following:

a. Difficulty in applying a system which makes it possible to obtain a vacuum in the envelope. In the most frequent case of a hand pump, the system is autonomous, but the force to be applied, as the vacuum increases, is considerable, even prohibitive when the user is a woman or child. In the case of an electric motor, utilization is easy but the system is no longer autonomous, and a source of power is required.

b. The step of establishing the predetermined pressure in the interior of the envelope is slow and a predetermined evacuation may not be obtained. If the evacuation in inadequate, the molding or the immobilization is of inadequate hardness, and in certain cases, serious consequences may result, particularly in the case of an injury to the spinal column. Conversely if the vacuum is too high in a unit containing balls of low density, the result will be that the reduction of the modeling will be too consistent and there will be the risk of excessive squeezing. In the systems known in the art, a given vacuum cannot be reproduced.

The present invention makes it possible to mitigate the drawbacks mentioned hereinabove. Specifically, the device of the present invention makes it possible, when a rapid depressurization is applied in this envelope, on one hand to minimize the presence of wrinkles in the skin of the envelope used during the modeling, and, on the other hand it permits to avoid the poor distribution of the balls in the envelope. The combination of a vacuum-generating unit, permitting a rapid depressurization, and an elastic envelope makes it possible to obtain very rapidly a molding with no wrinkles, this molding offering predetermined characteristics, due to the constancy of the vacuum produced.

The consistancy of the vacuum is obtained when a vacuum-generating unit which includes a gas generator is used. If the volume of gas contained in the elastic envelope is known, the vacuum to be obtained in the interior of the envelope depends on the amount of gas present. It is easy, therefore, with the use of a gas generator to produce a known volume of gas, to arrive at the desired consistency of the molding, and to achieve this result in a reproducible manner.

Among the various gas generators which it is possible to use within the scope of the present invention, one of the embodiments consists of using a pyrotechnic gas generator equipped with a powder block. The gas is then produced by the combustion of the powder block. However, a fast-acting gas generator using a supply of compressed gas or vaporizable liquid, may also be used.

The invention and its various advantages will be better understood from the following description and drawings of which:

As a function of the use to be made of the system, several kinds of modeling structures may be used but the envelope constituting these various structures, and this is one of the novel features of the invention, is made of an elastic material.

Figure 1:
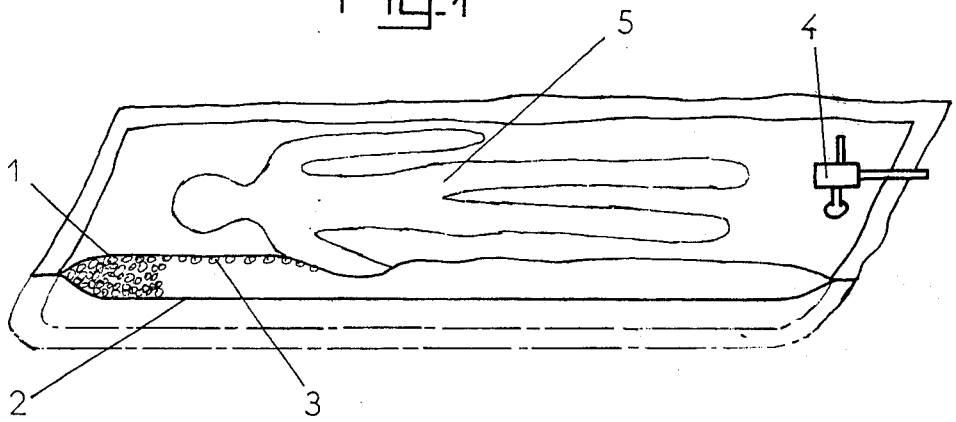
FIG. 1 is a view in perspective and longitudinal section of a stretcher mattress equipped with a vaccum-generating unit.

FIG. 1 shows, very schematically, an immobilizing unit according to the invention. It includes, insofar as the modeling structure is concerned, essentially two distinct skins 1 and 2 which are elastic and leakproof, joined at their peripheries in leakproof fashion, for example by vulcanization if the two skins are made of an elastomeric material. In the interior of the envelope thus formed, a plurality of elements, such as balls, is introduced, marked as a whole at 3. These elements are constituted of a material which is both resilient and deformable, for example balls of expanded polystyrene. The spherical form for the elements 3, although not essential is the most common in actual practice.

The dimensions of the balls, or more generally of the elements, are not critical, provided they are small, in the order of one millimeter of 0.4 to 6 mm in the various embodiments which are described hereinbelow. Since the system operates at a constant vacuum, the density of the material which constitutes the balls will vary according to the use planned for the system, that is according to whether the molding is to have a higher or lower consistency and whether the weight supported by the envelope being used is, for a given surface, higher or lower. This density of the material also varies if a reduction in the modeling, that is a squeezing, is to be obtained. This density varies approximately from 10 to 50 kg/m$^3$.

With balls of 10 kg/m$^3$, that is easy to crush between the fingers, the contraction of the modeling and consequently the squeezing, is better achieved than with balls of material having higher density. The modeling of the elements to be protected is designated by numeral 5. Numeral 4 designates the vacuum-generating unit.

Figure 2:
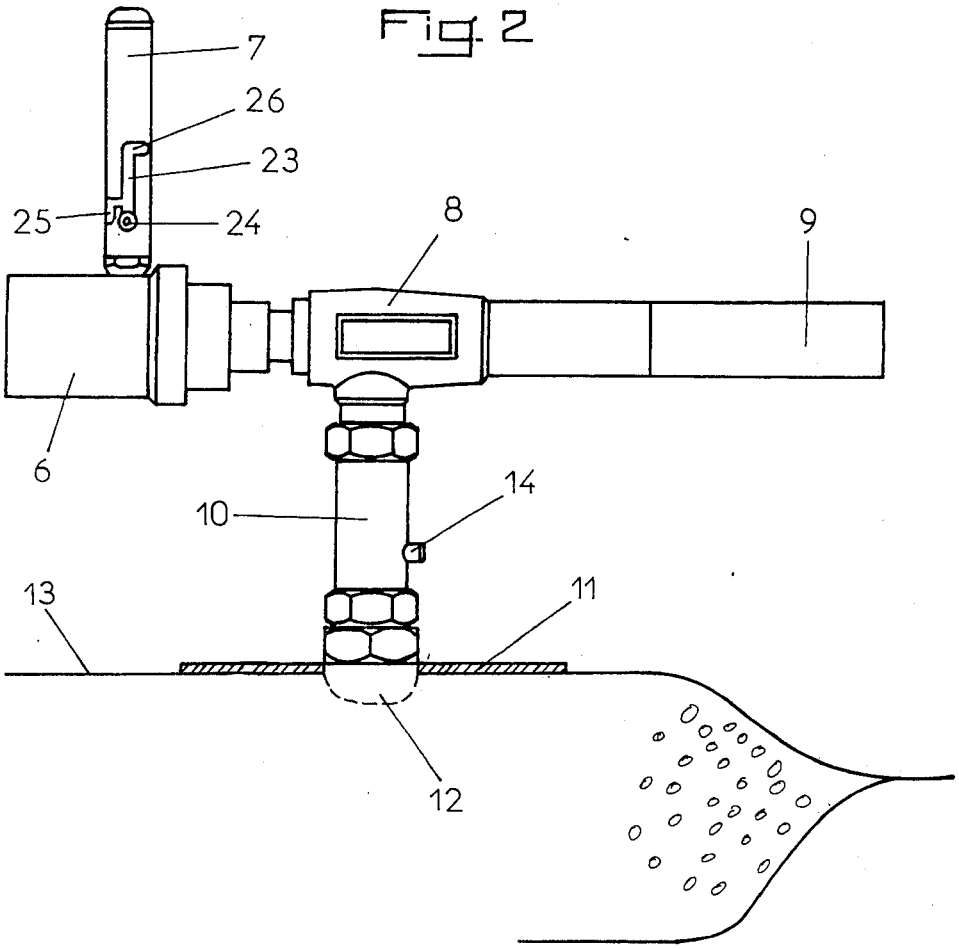
FIG. 2 is an exterior view of a vacuum-generating installation and a partial section of the part of the stretched mattress which is connected to the vacuum generating unit.

FIG. 2 represents in one-half scale, an exterior view of the vacuum-generating unit which is composed of a gas generator 6, a firing pin 7 and an ejector 8. The discharge orifice of the ejector opens into the atmospheric air, or in general into the fluid surrounding the system, through a muffler 9. A leakproof non-return valve 10 is placed between the ejector and the connecting surface 11. This connecting surface equipped with a filter 12 is provided in the skin 13 to connect the space in the interior of the envelope with the vacuum generator. An orifice temporarily closed tightly by a manual control 14 can cancel the effect of the non-return valve and permit the restoration of ambient pressure in the interior of the envelope.

Figure 3:
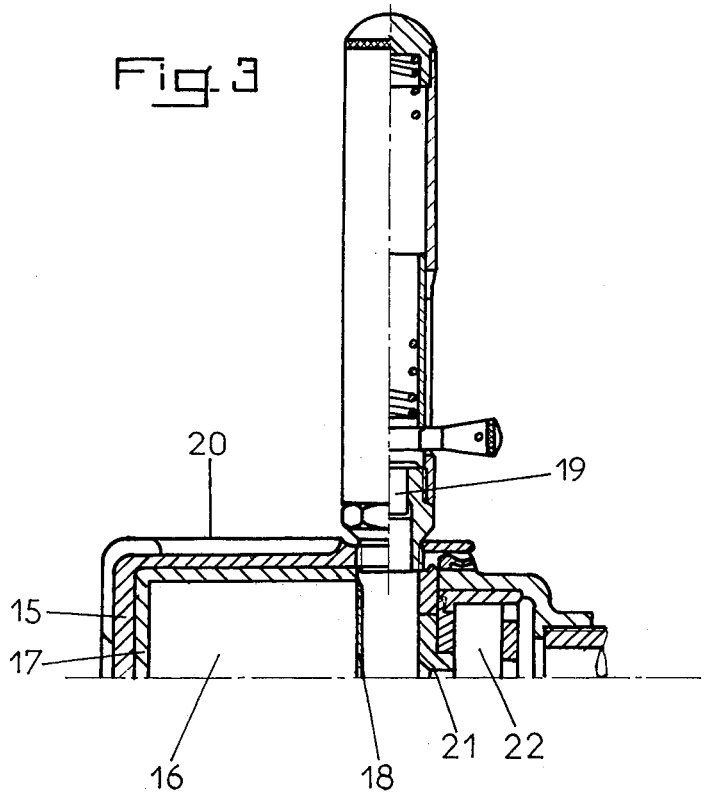
FIG. 3 is a one-half view in section of a pyrotechnic gas generator equipped with a firing pin represented in a cross-section.

FIG. 3 shows, on a scale of 1, a section through the gas generator and a cross-section of the firing pin. The gas generator is composed of a ferrule 15 inside which is a powder block 16 coated with an inhibiting varnish 17. On its front portion 18, the powder block is covered with a coating made of an ignition composition. This composition is itself ignited by the flame from the primer 19 placed at the bottom of the firing pin. Ferrule 15 is surrounded by a sheath of perforated metal 20 which serves as thermal protection, preventing the burns caused by direct contact with the ferrule when the powder block is burning. During this combustion period, the hot gases pass through nozzle 21, expand in the chamber 22, and then are injected into the converging cone of the ejector.

As shown in FIG. 2, the firing pin comprises a long vertical slit 23 for the passage of the hand-lever or handle 24 and two notches, one vertical 25 and the other horizontal 26 placed perpendicularly above the vertical slit 23. In the idle position, the handle 24 is in the notch 25. To cock the firing pin, it is sufficient to bring the handle 24 into notch 26, this operation tensioning a spring which forms part of said handle. When the handle drops back along the vertical slit 23, under the action of the spring, the tip of the firing pin strikes a primer placed in a primer pan. The primer ignites and then ignites the coating and then the block of powder itself.

It should be noted that the firing pin described hereinabove is only an example, and other firing pins working according to other principles are perfectly suitable. The gas-generating powder is preferably a low-potential type, and epictetic powders or homogenous double-base powders having a potential below 600 cal/g are particularly suitable. On the other hand, it is preferable to have the operating pressure relatively low, and below 100 bars. The epictetic powders burning at a pressure close to 50 bars give the best results.

The combustion time of the block should preferably be between 6 seconds and 1 minute, in order to permit a better modeling, and a time of 11 seconds is particularly suitable.

No matter which type of powder is used, the combustion surface is advantageously constant during the combustion, and for this reason, preferably a block with frontal combustion is used.

Figure 4:
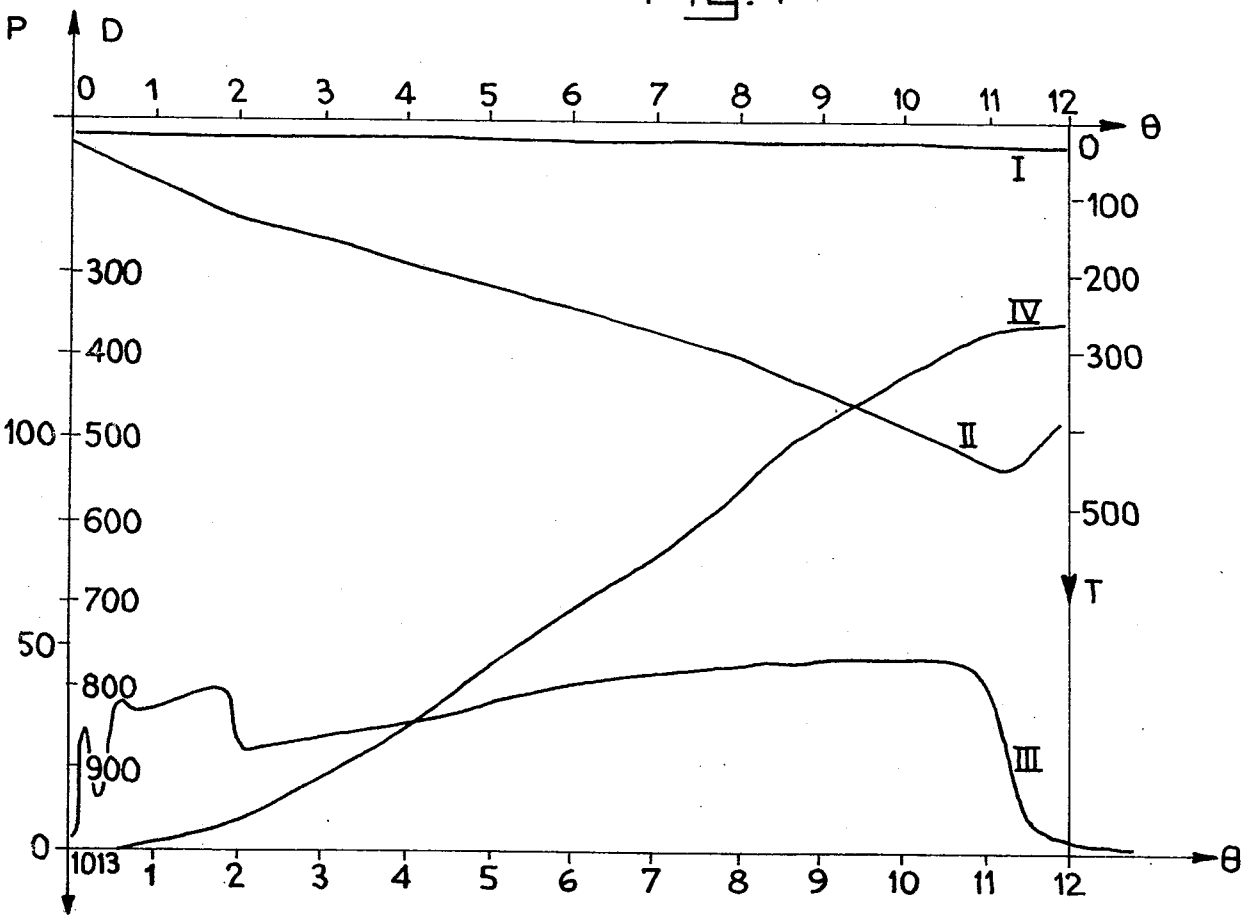
FIG. 4 represents the curves obtained during a test of the stretcher mattress equipped with a vacuum generating unit.

FIG. 4 combines the various curves obtained in the course of a test made with a stretcher mattress connected to a vacuum-generating unit as shown in FIG. 2. On the P axis, is plotted the pressure of the block, in bars; on the D axis the residual pressure of the stretcher mattress is plotted expressed in millibars; on the $\theta$ axis, is plotted the time in seconds; on the T axis is plotted the temperature in degrees centigrade. Curve I represents the outer temperature of the ferrule, Curve II indicates the temperature of the gases at the outlet to the ejector; Curve III shows the variations in the pressure of the block; Curve IV represents the residual pressure in the interior of the stretcher mattress as a function of the time.

The test which provided the data to assemble Curves I–IV was run under the following conditions.

The stretcher mattress was filled with balls of expanded polystyrene, with a mean volume of air to be aspirated of 50 liters;

The block of propergol consisted of 37 g of epictetic powder having a composition by weight of 57% nitrocellulose; 30% stabilized nitroglycerine; 8% triacetin; 5% of several additives. The term "propergol" means a propellant. The term "epictetic powder" means a "cast double base propellant." The additives are substances conventionally included in powder blocks for ballistic modification such as 2% 2-nitrodiphenylamine and 3% lead stearate but other substances could be used, such as diethylhexylphthalate, lead salicylate or lead 2-ethyl hexoate.

A block of the the composition as defined hereinabove will burn at a pressure not exceeding 45 bars, for 11 seconds with a substantially constant flow per unit of mass of 3.35 g/s. The volume of the propelling gas is 39 liters, and the pressure prevailing in the mattress at the end of 11 seconds is 390 mb.

The cast double base propellants may be handled safely provided the temperature is not allowed to rise above the point of auto-ignition, which is in general about 300° C. The block of powder is ignited when the primer 19 ignites thus causing the ignition of the coating which covers the block of powder itself as illustrated in FIGS. 1 and 2. By means of the gas generator, a constant volume of gas is formed which permits to achieve a predetermined vacuum in the envelope. Adequate molding for the protection of an individual may be rapidly obtained without wrinkels because the balls within the envelope are well distributed.

In this test, only one non-return valve is inserted between the intake and the stretcher mattress. This valve opens at a few tens of millibars of vacuum, and closes very quickly, being perfectly leakproof. Among the various non-return valves available, valve Tj, reference 3120, made by the Societe Clapet Socla of Chalons-sur-Saone has given complete satisfaction. The ejector used, sold on the market under No. 2325.55, is made by Societe SAPELEM.

Various improvements may be envisaged concerning the vacuum-generating unit, particularly in regard to the temperature of the gases at the outlet to the muffler. For this purpose conventional means of cooling may be adapted such as addition of supplementary air not coming from the stretcher mattress, coolant placed at the outlet of the combustion chamber, in particular by the use of substances sublimable at temperatures below 200° C. Under these conditions, there is no risk that the gases evacuated will cause burns.

In addition to the stretcher mattress, there are several modifications of the modeling structure and some embodiments are shown in FIGS. 5 to 18. These modeling structures are not used for transporting wounded people but are used as a seat for heavy engines, special means of conveyance or for showrooms.

Figure 5:
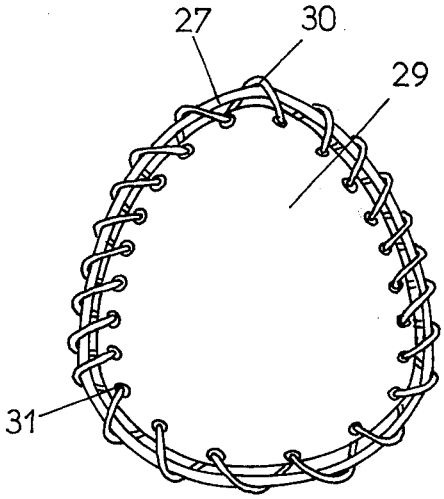
FIG. 5 is a top view of a seat according to a first embodiment of the invention.

FIGS. 5 to 8 show an example of a seat; FIG. 5 is a top view of the seat in which the molding structure, having an approximately oval form, is fixed to a frame 27 which may be metallic. The envelope is constituted by two skins 28 and 29, made of rubber, joined directly by vulcanization. They are stretched over the frame 27 by a strap 30. For this purpose, eyelets 31 are placed on the perimeter of the envelope which is reinforced by a strip of rubberized cloth 32. The latter, at the same time insures the distribution of the stress of suspension on the periphery, while doing away with the elastic suspension of the trim 33, which is made for example, of Helanca. Helanca, which is a cloth stretchable in all directions, is advantageously placed on the upper skin to prevent direct contact with the rubber. This trim skin may also be spread or glued.

The oval form of the frame represented in FIG. 4 has proved, in the course of tests, to be the most convenient. The protection insured by such a seat has made possible the vertical fall of a man of 75 kg, from a height of 4 meters with no bodily damage. Since the skins 28 and 29 are elastic, no wrinkles are formed when the pressure in the interior of the envelope is reduced, provided that the skins are slightly stretched in the idle state, that is when equal pressures prevail in the interior and on the outside of the envelope. As a result, the skin receiving the element to be modeled or immobilized, follows in an absolutely continuous fashion, the surface of the element which is placed on it, thereby producing an actual modeling.

Figure 6:
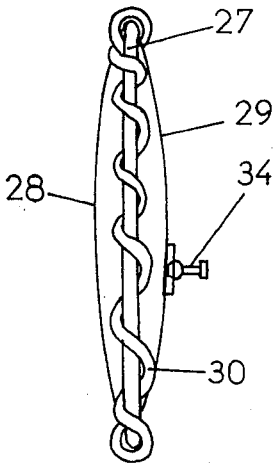
FIG. 6 is a profile view of the seat shown in the top view in FIG. 5.

The modeling structure is connected to the vacuum-generating unit by the non-return valve 34. FIG. 6 is a profile view of this seat.

Figure 7:
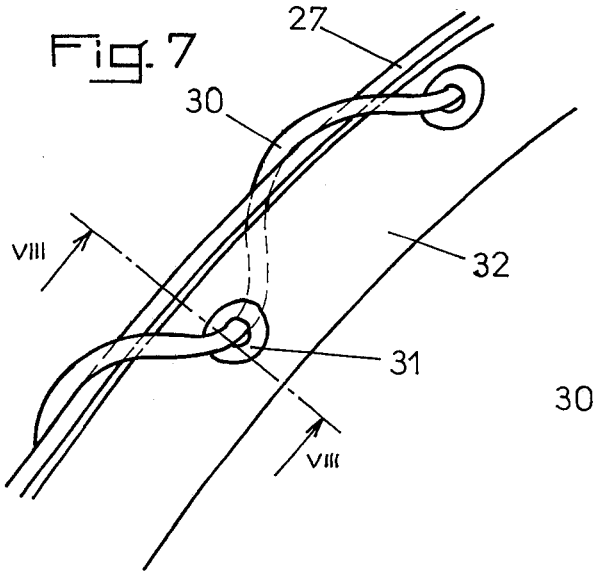
FIG. 7 is a detail view of the attachment of the envelope to the frame of the seat shown in FIG. 5.
Figure 8:
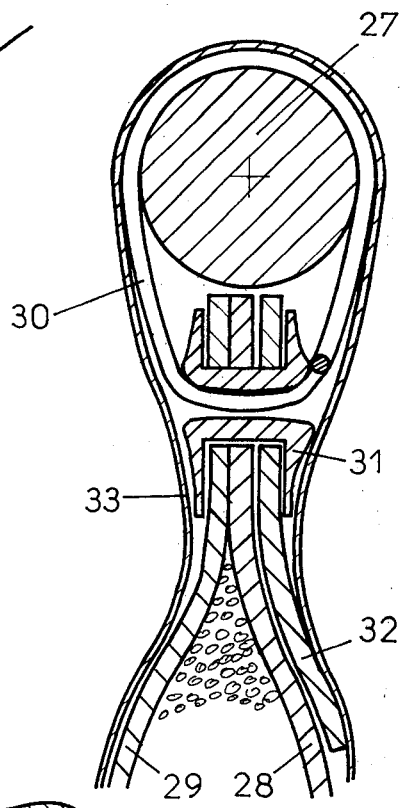
FIG. 8 is a detail view in section along VIII of the attachment of the envelope shown in FIG. 7.
Figure 9:
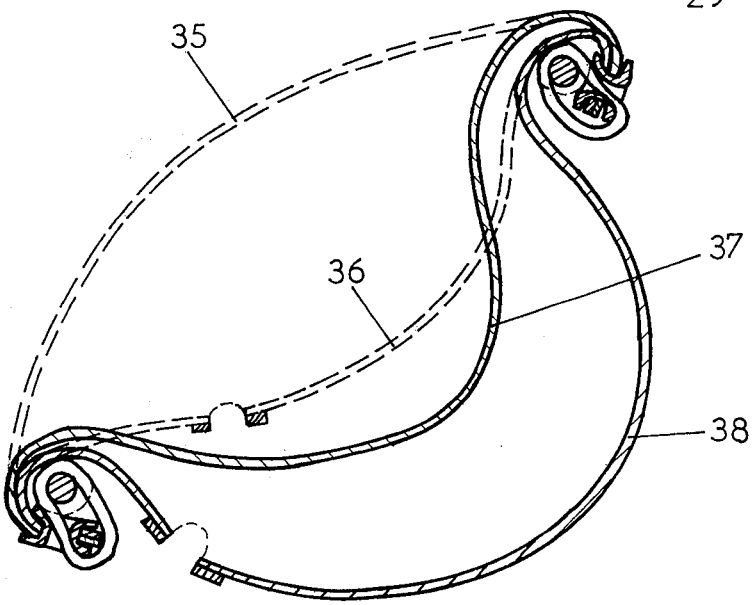
FIG. 9 is a section along a vertical plane of a seat according to a second embodiment of the invention showing in dashed line the seat idle and showing in solid lines the deformation of the seat under a load.

FIGS. 7 and 8 are partial enlargements of FIGS. 5 and 6. FIG. 9 illustrates a profile section of the seat when idle, with the solid lines representing the deformation of the skins 37 and 38 when the element to be protected is placed on the seat.

Figure 10:
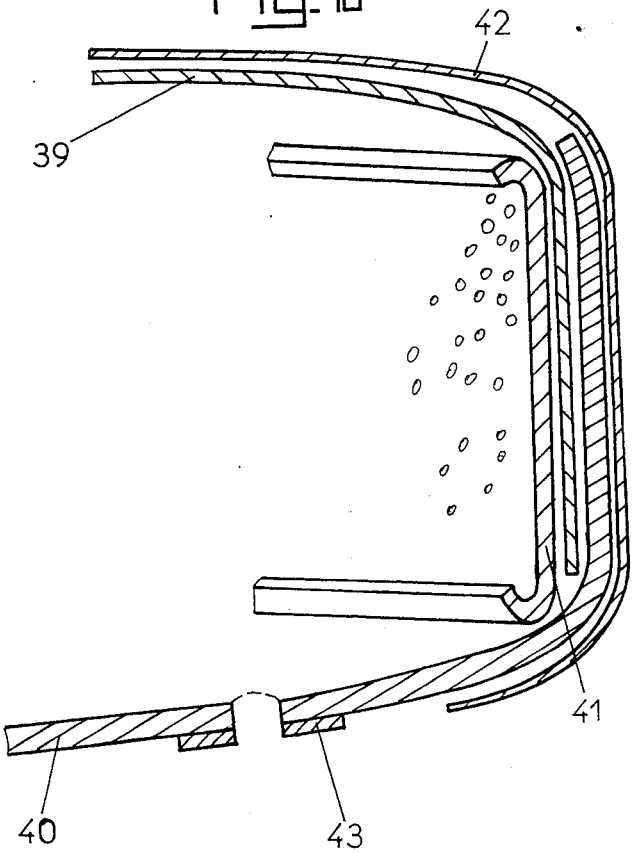
FIG. 10 is a partial section showing a part of a seat according to a third embodiment of the invention.

According to another form of embodiment of a seat according to the invention, partially shown in FIG. 10, the two skins 39 and 40 are joined by means of a leakproof, preferably rigid frame 41, like the skins of a drum. It is then unnecessary to provide a suspension of the skins, because the frame itself forms the reinforcement for the seat. The trim cloth is designated by numeral 42. The envelope is connected to the vacuum-generating unit by the connecting surface 43.

Figure 16:
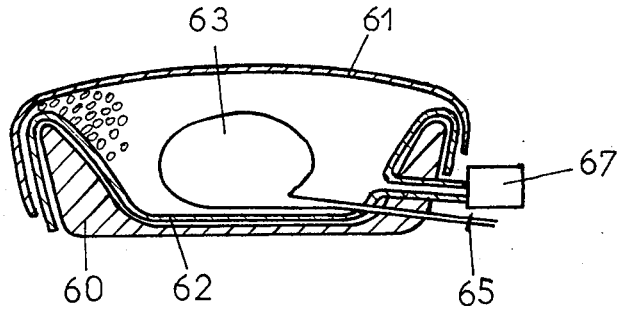
FIG. 16 represents in section, an envelope placed in the interior of a frame, equipped with means for breaking up the imbrication of the balls, with the envelope constituting a part of the seat shown in FIG. 14.
Figure 18:
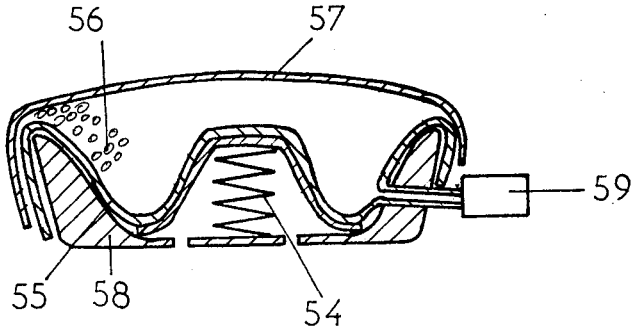
FIG. 18 shows in section an envelope placed in the interior of a frame, equipped with means for increasing the elasticity of the skins and making possible to break up the imbrication of the balls, with the envelope constituting a part of the seat shown in FIG. 14.

The leakproof envelope may, of course, be placed inside a rigid casing as shown at 60 in FIG. 16 or at 58 in FIG. 18. In the embodiment of FIG. 16, only skin 61 works and undergoes deformation. In the limiting case skin 62 may be omitted, provided the chamber formed by the casing 60 and skin 61 is leakproof.

The seats of FIGS. 5 to 10 are very efficient modeling devices in the case of immobilization in seated position of normal duration.

Figure 11:
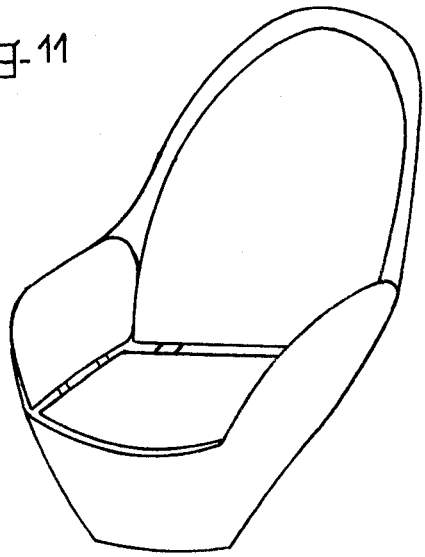
FIG. 11 is an exterior view in perspective of a seat composed of several envelopes according to a fourth embodiment of the invention and equipped with a vacuum-generating unit.
Figure 12:
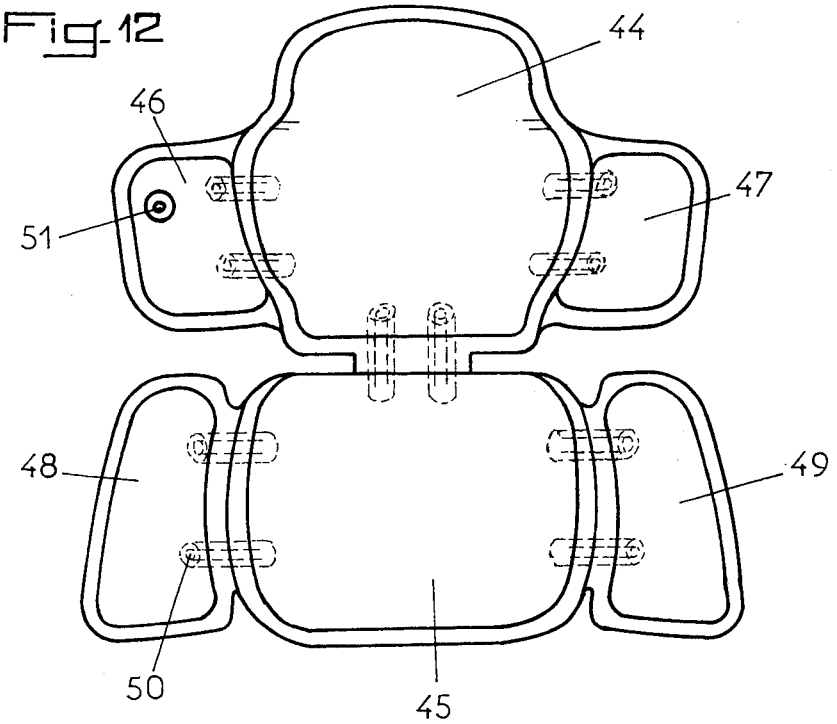
FIG. 12 is an exploded view in a single plane of the assembly of the six envelopes constituting the seat shown in FIG. 11.

For use in long-term immobilization, or for a more complex use, for example in the case of drivers or conductors of heavy engines, the seat shown in FIGS. 11 and 12 according to this invention is used. It comprises several leakproof envelopes, six in this example, with the assembly forming a sort of armchair inlaid in a metallic shell. The envelopes are made according to the principle described hereinabove. They are distributed so as to form a back envelope 44, a seat, envelope 45 and four sides or flanks, two for the back, envelopes 46 and 47 and two for the seat, envelopes 48 and 49. The outer contours are then glued to the shell.

The internal spaces of the envelopes communicate by means of tubes 50 so that by a single orifice 51 a relative vacuum can be established in the assembly of the envelopes. These rubber tubes must be sufficiently rigid so as not to flatten when the vacuum is created. In addition, the interior diameter of these tubes must be slightly greater than the diameter of the resilient bodies so that the latter will not obstruct the tubes when the vacuum is created in the envelopes, or conversely, when the outside pressure is restored in these envelopes.

Figure 13:
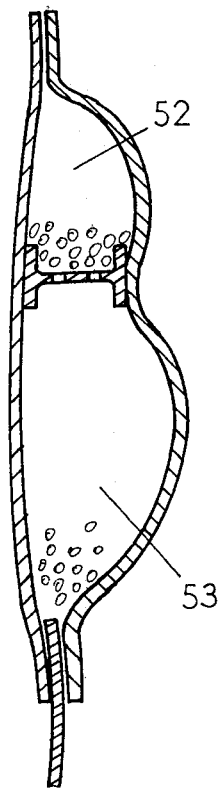
FIG. 13 is a section through a vertical plane of the back of the seat shown in FIG. 11, according to a modification of the back of the seat.

The back itself may be separated into two compartments, as illustrated in FIG. 13 which is a profile section of the back thus obtained. The latter consists of two separate envelopes 52 and 53, the lower envelope 53 containing a greater charge of balls in order to assure better support of lower organs, while the upper envelope 52 serves only as a light support of the shoulders. For the purpose of improving the modeling, it is also possible to utilize in the envelopes 52 and 53 balls made of different materials having a different density. In this case, the density of the material of which the balls of the lower envelope are made is greater than the density of the material of the balls contained in the upper envelope.

Figure 14:
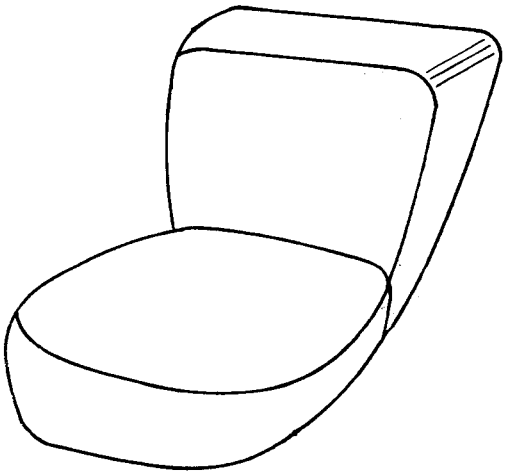
FIG. 14 is an exterior view of a seat according to a fifth embodiment of the inyention when the seat is idle.
Figure 15:
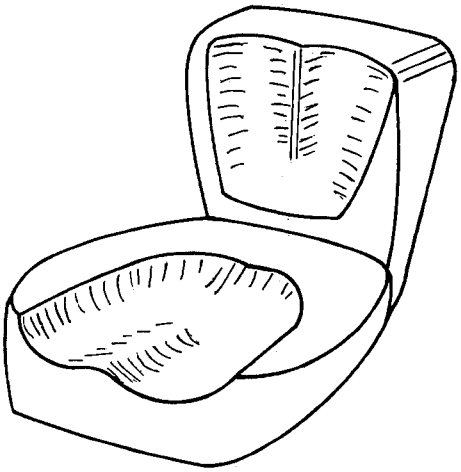
FIG. 15 is an exterior view of the imprint left on the seat of FIG. 14 by the element which is to be protected, when the element is withdrawn, but when the vacuum is maintained.

As it has been described hereinabove, the creation of a vacuum in the interior of the envelope gives the result that a compact block is formed due to the imbrication of the resilient bodies. When the outside pressure is restored in the envelope, the compact block has a tendency to remain. Therefore, even when the pressure prevailing in the envelope is the outside pressure, the forms produced by the modeling are not destroyed. This is shown in FIG. 15. Ordinarily after the system of protection by modeling has been used, it is necessary to break up the imbrication of the balls, by tapping the system, in order to give it its initial form as shown in FIG. 14. The present invention describes several means for breaking up the imbrication.

The slight tension of the skins in the idle state contributes to breaking up the imbrication of the balls, so that the envelope is ready to be used again as soon as the ambient pressure is established therein.

The imbrication of the balls is destroyed still more rapidly if the tension of the skins is different and/or if the skins are of different thickness, because the skins which are thinner and/or less stretched must be in contact with the element to be modeled or to be immobilized so as to assure a better modeling contact. However, the upper skin must not be slackened in the idle state and the lower skin must not be stretched too much, otherwise the imbrication would not be destroyed spontaneously when the pressure in the interior of the envelope is restored thus eliminating the imprint previously formed.

Another means which may be utilized according to the invention to eliminate the imbrication of the balls is to place at least one spring, which may be a spiral or blade spring, or a material having properties analogous to springs, such as foam, under the lower skin as indicated at 54 in FIG. 18. The spring may be used together with the material having the properties analogous to a spring. In addition to its function of destroying the imbrication, this creates a reserve in the form of volume, without being included in the envelope. The purpose of this arrangement is to spread and to push the lower skin 55 so that it forces the balls 56 to transmit this effect to the upper skin of the envelope 57. The spring takes support, preferably on a rigid casing 58.

A light weight, situated in the center of the envelope, will compress the spring and release the initial reserve due to the tension of the spring, thus permitting the play, the sliding of the balls and the matching of the forms laid at the upper skin 57. The vacuum-generating assembly is designated as a whole at 59. In other words, this embodiment permits to adapt this process to conventional frames. The form, in the absence of internal vacuum, is conventional also due to the fact that in the absence of weight, the spring or springs give the impression of a complete filling, the rate of filling being equal to or greater than 100%. When an individual sits down, the spring or springs are compressed, the volume which the springs had occupied is released thus permitting modeling in an approximately half-filled envelope, that is, under the conditions necessary for good modeling. This system avoids any other system of stretching the top skin which always remains under tension either under the action of the weight placed thereon, or under the action of the spring. According to the number and form of the springs, one can easily vary the reserve volume equivalent to a variation of the filling rate.

The springs used are comprised between the lower limit which is to raise the weight of the envelope and of the balls contained therein and the upper limit which is the total flattening under the additional weight of the body considered. It is evident that the imprint will be preserved, even in the absence of the initial weight when the interior of the envelope is kept under vacuum after any modeling.

Figure 17:
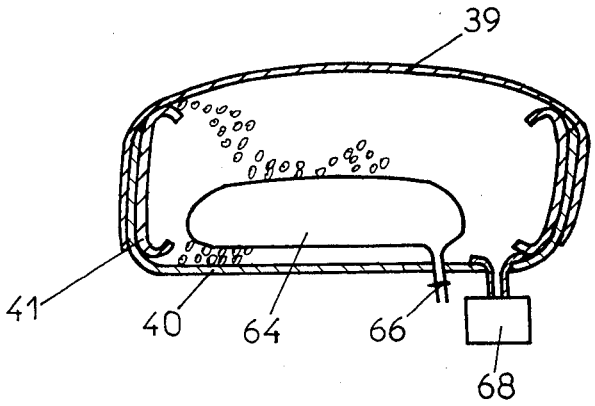
FIG. 17 shows, in section, an envelope provided with means for breaking up the imbrication of the balls with the envelope constituting a part of the seat, which is shown in partial section in FIG. 10.

FIGS. 16 and 17 show in profile section another means according to the invention to undo automatically the imbrication of the balls, which means can be associated with a different tension of the skins. It consists of a soft, leakproof, preferably elastic auxiliary envelope designated by numeral 63 in FIG. 16, and numeral 64 in FIG. 17. This auxiliary envelope is placed inside the previously described envelope, which is referred to as main envelope. This auxiliary envelope is equipped with a valve designated by numeral 65 in FIG. 16 and numeral 66 in FIG. 17. The valve opens in leakproof manner to the exterior of the main envelope. For example, in FIG. 17, the envelope 64 may be of simple form of the type of an inner tube of a bicycle or car, depending on the dimensions of the skins 39 and 40.

By creating by any known means a slight excess pressure in the envelope 64, one causes the breaking up of the imbrication of the balls. The same applies to envelope 63 of FIG. 16. This auxiliary envelope, as the reserve obtained by a spring previously described, presents also the advantage of permitting an adjustment of the rate of filling of the molding or modeling.

The fact that a reserve volume is included, whether by springs or by ballons, permits a rate of artificial filling of the balls equal to or greater than 100%.

The entire vacuum-generating assembly is designated by numeral 67 in FIG. 16, and 68 in FIG. 17.

Various modifications of the devices described may, of course, be made because the examples, which have been described in detail have been provided only for the purpose of illustration of the present invention.

What is claimed is:

1. A system of protection by modeling or immobilization or both which comprises at least one flexible and leakproof envelope, a plurality of resilient and deformable bodies within said envelope, means permitting to create a vacuum inside said envelope, said envelope consisting of two separate, elastic skins, joined together so as to insure the leakproofness of said envelope; said means permitting to create a vacuum comprising a gas generator, a pump placed downstream of said generator, the pump having an ejector, said generator communicating with the ejector of said pump, a suction orifice in said envelope in communication with the collector of said pump through a non-return valve, the gas generator being a pyrotechnic generator provided with a powder block, the resilient and deformable bodies being balls of diameter between 0.4 and 6 mm., the powder block having a duration of combustion in the range of 6 seconds to 1 minute.

2. The system according to claim 1 which comprises a plurality of elastic and leakproof envelopes joined together by tubes permitting the inflow and evacuation of the fluid contained in said envelopes, said tubes being sufficiently rigid so that they do not flatten under vacuum and of a diameter slightly greater than that of the resilient and deformable bodies, the envelopes forming a back, a seat and four sides, of which sides tow are at the back and two are at the seat.

3. The system according to claim 2 wherein said back is divided into two chambers, the lower of which supports the lower organs of a human being, and the upper chamber supporting the shoulders, the coefficient of filling of the lower chamber with resilient bodies being greater than that of the upper chamber.

4. The system according to claim 3 wherein the density of the resilient and deformable bodies contained in the lower chamber is greater than that of the resilient and deformable bodies contained in the upper chamber.

5. A system of protection by modeling or immobilization or both hich comprises at least one flexible and leakproof envelope, a plurality of resilient and deformable bodies within said envelope, means permitting to create a vacuum inside said envelope, said envelope consisting of two separate, elastic skins, joined together so as to insure the leakproofness of said envelope; said means permitting to create a vacuum comprising a gas generator, a pump placed downstream of said generator, the pump having an ejector, said generator communicating with the ejector of said pump, a suction orifice in said envelope in communication with the collector of said pump through a non-return valve, wherein each envelope is equipped with means for breaking up the imbrication of said resilient and deformable bodies when the fluid pressure which prevails outside said envelope is restored inside the envelope.

6. The system according to claim 5, wherein said means are constituted by the envelope itself, the two skins being made of the same material, the skin in contact with the body to be protected being less thick than the other skin.

7. The system according to claim 5, wherein said means consist of at least one spring and the system comprises a casing, said spring being located between the lower skin and said casing, the spring being secured to said casing.

8. The system according to claim 5, wherein said means consist of an element made of a substance of properties similar to a spring, and the system comprises a casing, said element being located between the lower skin and said casing.

9. The system according to claim 8 additionally comprising at least one spring which is located between the lower skin and said casing.

10. The system according to claim 5, wherein each said envelope is the first envelope and said means consist of a leakproof, auxiliary envelope, placed inside each said first envelope, the pressure inside the auxiliary envelope being adjustable.

11. The system according to claim 1, wherein the powder block of the gas generator presents a constant combustion surface.

12. The system according to claim 1, wherein the powder block presents, on a front surface, a coating made of an ignition composition said gas generator comprising a firing pin and a primer, and the coating being ignited by the flame of said primer situated in the lower part of said firing pin.

13. The system according to claim 1, wherein the powder block is made of a composition presenting a potential of less than 600 cal/g and a combustion pressure lower than 100 bars.

* * * * *